United States Patent [19]

McCandless et al.

[11] B 3,989,602

[45] Nov. 2, 1976

[54] METHOD OF MAKING REINFORCED COMPOSITE STRUCTURES

[75] Inventors: Lee C. McCandless, Silver Spring, Md.; Glenn E. Weber, Vienna, Va.

[73] Assignee: The United States of America as represented by the United States National Aeronautics and Space Administration, Washington, D.C.

[22] Filed: Apr. 19, 1974

[21] Appl. No.: 462,424

[44] Published under the second Trial Voluntary Protest Program on February 24, 1976 as document No. B 462,424.

[52] U.S. Cl. ..... 204/9; 29/527.2; 204/16; 204/40

[51] Int. Cl. ..... C23b 7/02; C23b 5/46

[58] Field of Search ..... 204/3, 4, 9, 16, 40; 29/527.2

[56] References Cited

UNITED STATES PATENTS

| | | | |
|---|---|---|---|
| 3,505,177 | 4/1970 | Chester et al. | 204/9 |
| 3,763,001 | 10/1973 | Withers | 204/16 |

FOREIGN PATENTS OR APPLICATIONS

| | | | |
|---|---|---|---|
| 85,173 | 5/1895 | Germany | 204/3 |

OTHER PUBLICATIONS

Plating, Apr. 1970, pp. 342–347.

*Primary Examiner*—T. M. Tufariello
*Attorney, Agent, or Firm*—Robert F. Kempf; John R. Manning; James A. Mackin

[57] ABSTRACT

A process for making composite structures built up on a mandrel having a smooth outer surface by winding a filament having at least one flat side as viewed in cross-section upon that surface with the flat side against it, and then electroforming matrix material on the wire and on the surface between spaced convolutions until the matrix material builds out beyond the level of the wound convolutions at all points, and then machining away the matrix material until a new smooth surface is attained on which to precision-wind the next filament convolutions with their flat sides in close contact therewith and with the spacings between convolutions very closely controlled.

6 Claims, 7 Drawing Figures

METHOD OF MAKING REINFORCED COMPOSITE STRUCTURES

GOVERNMENT CONTRACT

The invention described herein was made under a Contract with the National Space and Aeronautics Administration.

FIELD OF INVENTION

This invention relates to an improved process for making reinforced matrix composite structures of the type where reinforcing filament is wound on a body and metallic matrix material is electroformed on and between the windings to form each new layer of the composite structure.

BACKGROUND AND PRIOR ART

This invention seeks to improve upon the processes described in Withers U.S. Pat. No. 3,763,001 which teaches the concept of winding a fine filament of circular cross-section about a mandrel and depositing metal on and around the winding by electroplating, vapor deposition or metal spraying either after a complete layer of filament has been wound or alternatively during the winding of the filament. However, this patent acknowledges at column 3, lines 41 to 64 a problem which arises when using its claimed process, i.e. the existence of voids within the body of the composite structure due to the failure of the matrix metal to be deposited completely around the reinforcement filaments where circular cross-section filaments are being wound. Such circular filaments when wound on a surface leave an essentially wedge-shaped zone beneath the filament on each side thereof, and the matrix metal does not deposit therein, or else does not deposit at full density. The patent minimizes these voids by using very small diameter filaments and spacing them apart by at least one-half their own diameter. Later in the patent specification there is a statement at column 7 lines 34 to 55 that although larger filaments would be expected to give best results due to their greater reinforcement value, the smaller diameter filaments are necessary to be compatible with the lateral penetrating capacity, or "throwing" power, of practical deposition techniques.

Although at the time of obtaining the above patent it was believed that the void problem was solved by the use of small diameter reinforcement wire, subsequent analysis of electroplated matrices showed that it was not, and that voids remained in the recessed zones located between the surface of the previously deposited layer and the adjacent under-surfaces of the circular cross-section filaments wound thereon. The "throwing" power of electroplating solutions is of course not ideal, and therefore less metal is deposited in these recessed zones than on the remainder of the more exposed surfaces. The degree of metal deposition in the recessed zones is intimately related to the densities of the cathodic diffusion layers, i.e. the ionic boundary layers in the vicinity of the recessed zones where agitation or flow of the electrolyte is difficult to achieve for the purpose of breaking up the ionic boundary. Since the contour of the cathode surface in the recessed zones is in the form of a wedge-shaped pocket, the ionic diffusion layer will vary with position in the recess both as to density and distribution, and therefore the rate of mass transport of the depositing ions will also vary with position in the recess resulting in a non-uniform matrix growth pattern.

THE INVENTION

This invention provides improvements in the process of making high-strength nickel matrix structures achieved by using reinforcement filaments having improved cross-sectional shapes and by specially machining the structure after each deposition and before winding, which machining also facilitates highly precise placement of each winding convolution where the winding is done by precision apparatus while making structures of revolution about the winding axis, such as cylinders, pressure bottles, nozzles, etc.

It is a principal object of this invention to provide an improved process for making a void-free filament-reinforced matrix structure using filament which has at least one flat side, as viewed in cross-section and wherein the flat side of the filament is wound against the surface of the supporting mandrel or of a preceeding machined electroformed layer.

It is another principal object of this invention to provide a process in which the matrix metal is deposited by electroforming upon and between the wound flat-sided filament and wherein this depositing is continued until the metal between the filament convolutions is built out to a radius as measured from the winding axis which is greater at all points along the structure than the radius to the tops of the winding convolutions, and in which the structure is then machined to provide a smooth cylindrical surface of matrix material so that the next wound layer of flatted filament will lie snugly thereagainst and leave no voids between the filament and the machined surface. In the absence of such a machining step prior to the application of each new winding layer, the just-plated matrix material undulates and would present a rippled surface on which the straight side of the filament could not possibly lie flat, so that voids would appear almost everywhere beneath the winding. Moreover, on a rippled as-plated surface, it would be very difficult to lay the winding convolutions with precision spacing, and therefore a machining step between layers is necessary to provide a matrix structure having uniform reinforcement distribution throughout so that there are no weak spots in the finished product. In general the more filament that can be introduced into the matrix, without resulting voids, the stronger the finished structure. As will be discussed herein, there are limits as to how close together adjacent convolutions can be wound. The filaments must therefore be wound with great precision both as to axial and radial spacing in order to achieve uniform and maximum density while avoiding adjacent convolution spacings that are so close together as to leave plating voids therebetween.

It is a further object of the invention to provide a process yielding a finished structure in which the density of the matrix material is virtually uniform, and for this purpose it has been found that the spacing between the convolutions should be at least as great as one half the cross-sectional width of a filament as measured axially of the winding surface. The uniformity of density is also aided by using filament wire having a semicircular cross-section rather than having a greater thickness as measured normal to the winding surface. The closer the convolutions are spaced, the greater the effect of the cross-sectional shape of the wire on the uniformity of the plated matrix material for a plating bath of given throwing power. It should also be noted that since each new plated matrix bonds with the preceeding surface only between convolutions and not beneath the flats of the windings, it is important not to place the windings so close together as to deprive the new layer of sufficient bonded area.

Still another object of the invention is to provide a process in which excellent bonding between subsequent layers is insured by carefully degreasing and reactivating the machined surface and the new winding before electroforming the next matrix level upon that surface and upon the reinforcement convolutions wound on it.

Another object of the invention is to provide a process in which the ends of each new winding are secured in place during matrix metal electroforming using plastic screws to minimize dendrite formations at the edges of the structure.

DESCRIPTION OF DRAWINGS

Referring now to the drawings, FIG. 1 shows a cylinder 10 in various different stages. The cylinder is formed on a cylindrical mandrel 12 of conductive material, for instance, nickel in the present example. On its outer surface 14 a helix of reinforcement filament 16 has been wound, the filament 16 comprising stainless steel wire specially shaped to provide a D-shaped cross-section, the flat surface 18 of the wire being wound against the mandrel surface 14 as shown in the drawing. The matrix material 20, also nickel, is then plated upon the mandrel surface 14 and upon the exposed surfaces of the convolutions of the filaments 16, the electroplating bath being shown in FIG. 5, and including a electrolyte E in a tube T which electrolyte is agitated suitably by a motor-driven propeller P. A battery B is coupled between the mandrel 14 and an anode A, this showing being merely schematic because the step includes only techniques well known in the prior art.

Figure 1:
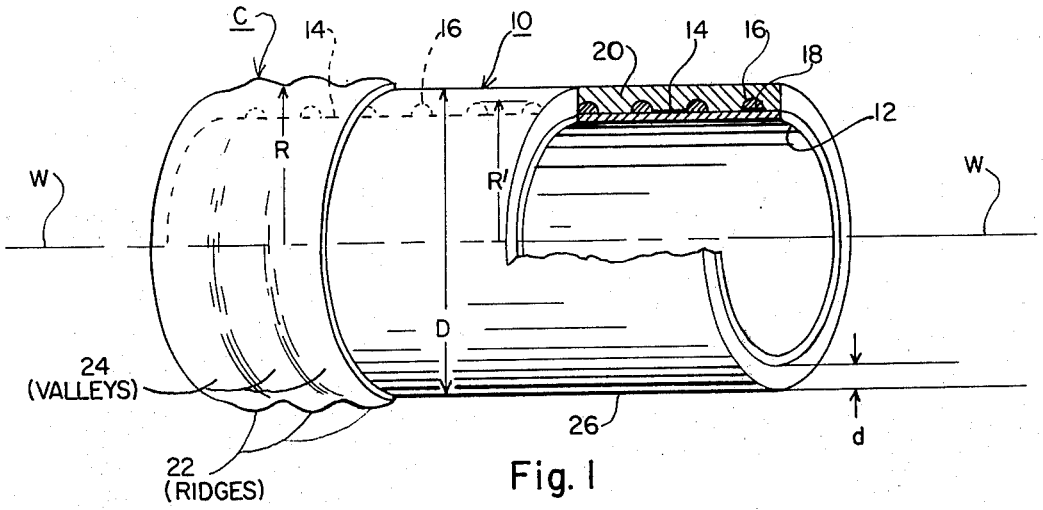
FIG. 1 is a perspective view partly in cross-section of a cylinder built-up according to the present process.
Figure 2:
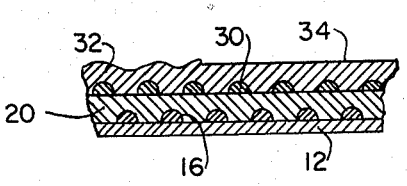
FIG. 2 is a cross-section through a similar cylinder showing two wire layers in a deposited matrix.
Figure 5:
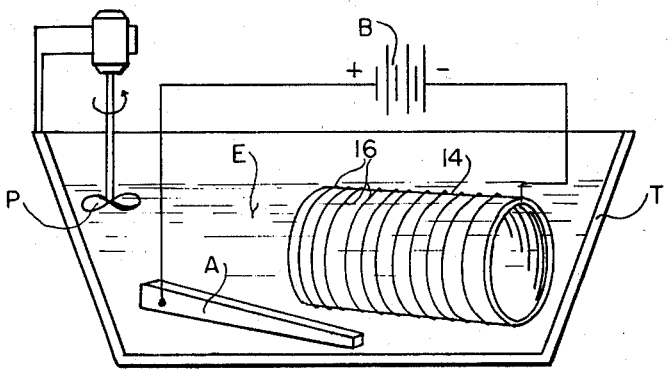
FIG. 5 is a view of a cylinder in an electroplating system.
Figure 6:
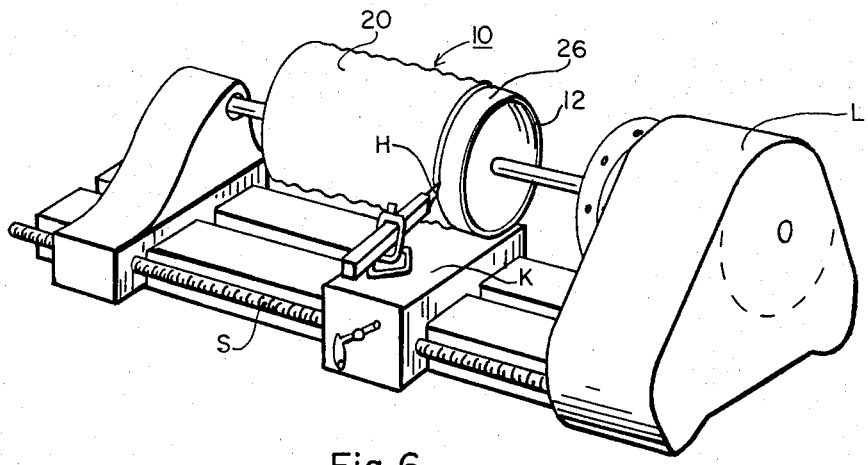
FIG. 6 is a perspective view of a cylinder having its surface machined in a lathe.

This electroplating is continued until the deposited metal 20 is built up so that at every point along the cylinder, FIG. 1, the radius R to the outer surface of the plated matrix 20 is greater than the radius R′ to the outer periphery of the wound filament 16, both radii being measured from the winding axis W which coincides with the axis of rotation of the cylinder 10. It should be observed in FIG. 1, near the left-hand end of the cylinder, that the as-plated contour C is not cylindrical, but undulates so that the ripples follow the contour of the underlying filaments 14, the contour having higher ridges 22 over the filaments 14 alternating with depressions 24 between the filaments. After the plating has provided a sufficient depth of matrix material 20, the cylinder 10 is removed from the plating bath, FIG. 5, and machined in a lathe as shown in FIG. 6 to cut the plated matrix material 20 back down to a selected diameter D as shown in FIG. 1 and to provide a precision cylindrical outer surface 26 on which the filament for the next layer will be wound to provide a multilayer structure as shown in FIG. 2, which will include a new filament winding 30 and a newly deposited matrix material 32, subsequently machined to a cylindrical surface 34. Although the lathe L in FIG. 6 is illustrated as having a cutting tool H mounted on its compound K, it should be understood that other ways may be used to provide a machined precision surface 26, for instance using a grinding machine (not shown). In any event the machining step provides a precision surface 26, but it also provides a very easy and convenient way of controlling the cross-sectional depth d of each layer as shown in FIG. 1, which control is necessary to achieve a given strength and ratio of matrix metal to reinforcement filament by volume.

Figure 7:
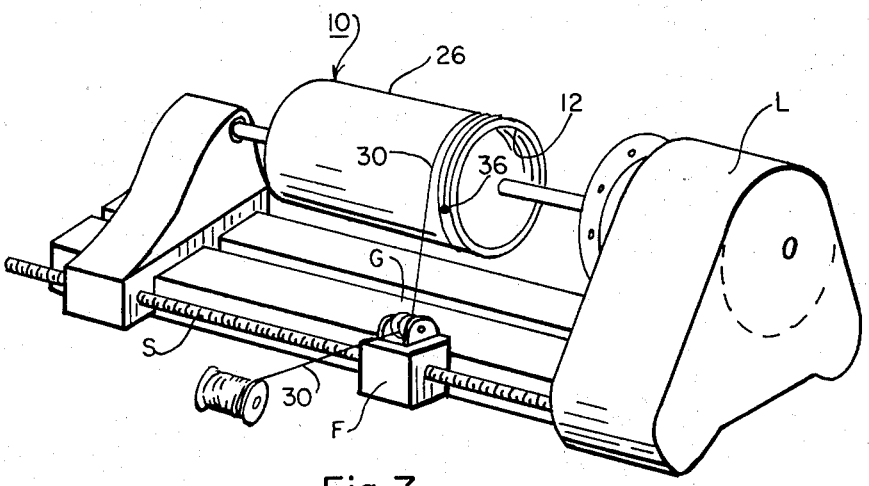
FIG. 7 is a perspective view of a cylinder having a filament precision wound on its surface in a lathe.

When the machining step is completed, the cylinder 10 is provided with a newly wound layer using the lathe L again, this time as shown in FIG. 7 where the lead screw S drives a wire feed carriage F having a grooved feed roller G which pulls the filament 30 from a supply spool and winds it upon the machined surface 26. The ends of the filament 30 are secured by plastic screws 36 during the subsequent plating step while the matrix metal 32 is being deposited.

Between the winding step and the next deposition step, the metal surfaces are degreased and chemically activated to insure optimum bonding of the matrix material to the machined surface 26 and to the newly deposited filament 30. Since interruption of the plating current or removal of the cylinder 10 from the plating bath will cause the nickel surface to become passive, it must be re-activated. It happens that the same steps which accomplish activation will also activate the stainless steel filament wire which at the time of each treatment has already been wound upon the cylinder's outer surface. The treatment is of course known per se in the prior art and includes degreasing the surfaces, soaking in commercial alkali-cyanide cleaner, activating in nickel potassium cyanide solution, and nickel striking in a Woods nickel bath, followed by final rinsing.

The wire selected for use in the several examples listed below was stainless steel type 302 with a nominal semicircular cross-section providing a D-shaped filament. Two sizes were used. The smaller size averaged 8 mils in width across the flat and 4.5 mils in height measured normal thereto; while the larger size averaged 19.3 mils in width across the flat by 10.4 mils in height. The smaller wire, measured over a six inch length, had a tensile strength which averaged about 390,000 psi, but the larger wire averaged about 277,000 psi. Other cross-sectional shapes are of course possible provided each has at least one flat side for winding against the machined surface, for instance, square or triangular wire. Wire sizes in the range of 8 to 200 mils are appropriate.

Figure 3:
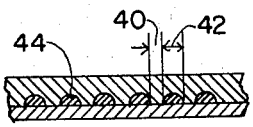
FIG. 3 is a cross-section of a similar cylinder showing a winding whose convolutions are nominally spaced close together.
Figure 4:
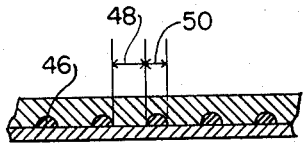
FIG. 4 is a cross-section of a similar cylinder showing a winding whose convolutions are spaced apart twice the width of a filament.

The wire was wrapped on a cylinder 10 of about 6 inches diameter in different tests using different spacings, including windings which were only nominally spaced by less than one-half the width of the filament; and including a precision spacing in which the spaces 40 between convolutions were equal to one-half the width dimension 42 of the wire 44, FIG. 3; and including another spacing as shown in FIGS. 1 and 2 where the convolutions of wire 16, or 30, were spaced by an amount equal to the width of the wire; and including a still wider spacing where the convolutions of wire 46 were separated by spaces 48 equal to twice the width 50 of a wire, as shown in FIG. 4. These different spacing samples were then plated to deposit nickel between and on the convolutions, and the results showed that in the cases of the one-half width and single width spacings the nickel filled the spaces uniformly without leaving voids, whereas, in the narrow nominal spacing samples the fill was incomplete, thus indicating that a one-half width spacing for semicircular filaments should be considered about minimum to produce void-free results.

EXAMPLES

The following tables show typical structures for cylinders made using the above reinforcing stainless steel wires in nickel matrices, several layers being applied in each case.

EXAMPLE NO. 1

4 Mil Nominal Height Wire (Semicircular)

| Layer No. | Thickness | | Material |
|---|---|---|---|
| 1 | .010 | inch | Electrodeposited Nickel on Mandrel |
| 2 | .004 | " | Wire |
| | .008 | " | Nickel over Wire |
| 3 | .004 | " | Wire |
| | .008 | " | Nickel over Wire |
| 4 | .004 | " | Wire |
| | .008 | " | Nickel over Wire |
| 5 | .004 | " | Wire |
| | .020 | " | Nickel over Wire |

EXAMPLE NO. 2

10 Mil Nominal Height Wire (Semicircular)

| Layer No. | Thickness | | Material |
|---|---|---|---|
| 1 | .015 | inch | Electrodeposited Nickel on Mandrel |
| 2 | .010 | " | Wire |
| | .015 | " | Nickel over Wire |
| 3 | .010 | " | Wire |
| | .020 | " | Nickel over Wire |

FURTHER EXAMPLES

Stainless Steel Wire Wrapped Nickel Cylinders Plated in Sulfamate-Chloride Bath

| Ex. No. | Wire H'gt. Mils | No. Wire Layers | AMP Sq.Ft. | pH | Bath .C | Plate Hrs. | * Plate TK. Mils. | Hoop Tensile Strength p.s.i. |
|---|---|---|---|---|---|---|---|---|
| 1 | 10 | 2 | 20 | 4.1 | 49 | 51 | 81 | 126,000 |
| 2 | 10 | 2 | 20 | 4.2 | 49 | 56 | 62 | 125,000 |
| 3 | 10 | 2 | 20 | 4.2 | 49 | 97 | 62.5 | 99,200 |
| 4 | 10 | 2 | 20 | 4.2 | 49 | 123 | 61 | 131,000 |
| 5 | 4 | 4 | 20 | 4.1 | 49 | 177 | 70 | Not Tested |
| 6 | 4 | 4 | 20 | 4.1 | 49 | 254 | 70 | 147,600 |

*Part of the plated thickness was machined away between successive windings.

Nickel 6 inch diameter cylinders which did not include filamentary reinforcements, when tested, showed an average hoop strength of about 80,000 p.s.i., a yield strength of about 65,000 p.s.i. and a modulus of $25.6 \times 10^6$p.s.i. The wire-wrapped cylinders showed an increase of about 19,200 to 67,000 p.s.i. in strength, which is in the range of 24 to 85 percent improvement for filament-to-matrix reinforcement ratios of 15 to 31 percent by volume. Those fabricated with higher percentage reinforcement should show even greater strengths. The measured hoop strengths agreed with calculated composite strengths based on the well-known rule for mixtures.

We claim:

1. The process of making a composite structure on a mandrel having a smooth outer surface, said structure including multiple layers of reinforcing filaments spaced at different levels and embedded in a metallic matrix material, including the steps of:

a. winding a filament having at least one flat side as viewed in cross-section onto said smooth outer surface with the flat side thereagainst and precision spacing successive convolutions;

b. depositing metallic matrix material by electroforming onto the convolutions of the filament and onto said outer surface exposed therebetween, and continuing such electroforming until the matrix material between the convolutions builds up above the level of the wound filament;

c. machining the structure by removing matrix material until a new smooth outer surface is exposed above the level of the filament; and d. repeating said steps to produce another layer.

2. The process as set forth in claim 1, wherein said filament is D-shaped in cross-section.

3. The process as set forth in claim 2, wherein said filament is semicircular in cross-section and said convolutions are spaced apart no less than one-half the width of the filament as measured across its flat side.

4. The process as set forth in claim 3, wherein said width of the filament is substantially within the range of 8 to 200 mils.

5. The process as set forth in claim 1, wherein the filament is stainless steel wire.

6. The process as set forth in claim 5, wherein the matrix material is nickel electroformed onto the filament and the exposed surface between convolutions, and wherein between each winding step and the subsequent electroforming step there is interposed the step of treating the wound convolutions and the surface therebetween by degreasing and reactivating them to insure bonding of the matrix material subsequently electroformed thereon.

* * * * *